US005647918A

United States Patent [19]

Kawana et al.

[11] Patent Number: 5,647,918

[45] Date of Patent: Jul. 15, 1997

[54] BAINITE WIRE ROD AND WIRE FOR DRAWING AND METHODS OF PRODUCING THE SAME

[75] Inventors: Akifumi Kawana; Hiroshi Oba; Ikuo Ochiai; Seiki Nishida, all of Chiba, Japan

[73] Assignee: Nippon Steel Corporation, Tokyo, Japan

[21] Appl. No.: 532,755

[22] PCT Filed: Apr. 6, 1994

[86] PCT No.: PCT/JP94/00575

§ 371 Date: Oct. 5, 1995

§ 102(e) Date: Oct. 5, 1995

[87] PCT Pub. No.: WO94/23086

PCT Pub. Date: Oct. 13, 1994

[30] Foreign Application Priority Data

Apr. 6, 1993 [JP] Japan ..... 5-079899

[51] Int. Cl.[6] ..... C21D 8/06; C22C 38/14

[52] U.S. Cl. ..... 148/320; 148/333; 148/598; 148/599

[58] Field of Search ..... 148/598, 599, 148/320, 333

[56] References Cited

U.S. PATENT DOCUMENTS 4,840,686 6/1989 Arnett et al. ..... 148/320

FOREIGN PATENT DOCUMENTS 53-56122 5/1978 Japan ..... 148/333

*Primary Examiner*—Deborah Yee

*Attorney, Agent, or Firm*—Wendroth, Lind & Ponack

[57] ABSTRACT

This invention provides bainite wire rod and wire excellent in drawability and methods of producing the same.

The bainite wire rod or wire is characterized in that it contains, in weight percent, C: 0.70–1.20%, Mn: 0.30–0.90% and Si: 0.15–1.00%, further contains as alloying components one or both of Al: 0.006–0.100% and Ti: 0.01–0.35%, if required contains Cr: 0.10–0.50%, and is limited to P: not more than 0.02% and S: not more than 0.01%, the remainder being Fe and unavoidable impurities, and has tensile strength and reduction of area determined by the following equations (1) and (2), $$TS \leqq 85 \times (C) + 60 \quad (1)$$

$$RA \geqq -0.875 \times (TS) + 158 \quad (2)$$

where

C: carbon content (wt %),

TS: tensile strength (kgf/mm$^2$), and

RA: reduction of area (%).

7 Claims, 1 Drawing Sheet

BAINITE WIRE ROD AND WIRE FOR DRAWING AND METHODS OF PRODUCING THE SAME

TECHNICAL FIELD

This invention relates to bainite wire rod and wire for drawing and methods of producing the same.

In this invention, "wire rod," when termed as a product, means wire rod processed for drawing by subjecting it to direct heat treatment immediately after rolling from a steel slab, while, "wire," when termed as a product, means wire subjected to heat treatment in preparation for drawing before drawing or after hot rolling and wire subjected to heat treatment for secondary drawing after being subjected to primary drawing by cold working following hot rolling.

BACKGROUND ART

Wire rod and wire are ordinarily drawn into a final products matched to the purpose of use. Before conducting the drawing process, however, it is necessary to put the wire rod or wire in a condition for drawing.

In the case of high-carbon steel wire rod or wire, the prior art requires that a mixed texture of uniform, fine pearlite and a small amount of pro-eutectoid ferrite be established before drawing, and, therefore, a special wire rod or wire heat treatment called "patenting" is conducted. This treatment heats the wire rod or wire to the austenite formation temperature and then cools it at an appropriate cooling rate to complete pearlite transformation, thereby establishing a mixed texture of fine pearlite and a small amount of pro-eutectoid ferrite.

In the wire rod production method of Japanese Patent Publication No. Sho 60-56215, a heat treatment is conducted for obtaining a mixed texture of fine pearlite and a small amount of pro-eutectoid ferrite by immersing the wire rod heated to the austenite formation temperature in molten salt and then cooling it from 800°–600° C. at a cooling rate of 15°–100° C./sec.

However, pearlite texture involves the problems of ductility degradation during drawing at a high reduction of area and of cracking in twist test (hereinafter referred to as "delamination").

The object of this invention is to provide wire rod or wire excellent in ductility and not giving rise to the foregoing problems during drawing, and to provided methods of producing the same.

DISCLOSURE OF THE INVENTION

For achieving this object, the present invention provides bainite-texture wire rod or wire having a chemical composition containing C, Mn, Si, and one or both of Al and Ti in an amount specified by the invention and, if required, further containing a specified amount of Cr, the upper limit value of P and S content being restricted, and further having prescribed tensile strength and reduction of area.

For achieving this object, the present invention also provides bainite wire rod or wire by increasing the cooling rate up to the nose position in the TTT diagram during cooling of wire rod after hot rolling or during heat treatment of wire after heat treatment at austenite formation temperature, thereby preventing formation of pearlite texture, and then isothermally holding the wire rod or wire at 350°–500° C. In other words, following rolling of the wire rod or heating of the steel wire it is cooled from the temperature range of 1100°–755° C. to the temperature range of 350°–500° C. at a cooling rate of 60°–300° C./sec and maintained at this temperature for at least a specified period to suppress formation of micromartensite texture and thus provide bainite-texture wire rod or wire excellent in drawability, whereby there is obtained wire rod or wire excellent in drawability even at a high reduction of area.

Specifically, the gist of the invention is as set out below.

(1) Bainite wire rod or wire for drawing characterized in that it contains, in weight percent,

C: 0.70–1.20%,

Mn: 0.30–0.90% and

Si: 0.15–1.00%, further contains as alloying components one or both of

Al: 0.006–0.100% and

Ti: 0.01–0.35%, is limited to

P: not more than 0.02% and

S: not more than 0.01%, the remainder being Fe and unavoidable impurities, and has tensile strength and reduction of area determined by the following equations (1) and (2), $$TS \leqq 85 \times (C) + 60 \quad (1)$$

$$RA \geqq -0.875 \times (TS) + 158 \quad (2)$$

where

C: carbon content (wt %),

TS: tensile strength (kgf/mm$^2$), and

RA: reduction of area (%).

(2) Bainite wire rod or wire for drawing according to paragraph 1 above characterized in that it further contains Cr: 0.10–0.50% as an alloying component.

(3) Bainite wire rod or wire for drawing according to paragraph 1 or 2 above characterized in that it has a microstructure of not less than 80% upper bainite texture in terms of area ratio and an Hv of not more than 450.

(4) A method of producing bainite wire rod for drawing characterized by rolling into wire rod a steel slab of a composition which contains, in weight percent,

C: 0.70–1.20%,

Mn: 0.30–0.90% and

Si: 0.15–1.00%, further contains as alloying components one or both of

A1: 0.006–0.100% and

Ti: 0.01–0.35%, is limited to

P: not more than 0.02% and

S: not more than 0.01%, the remainder being Fe and unavoidable impurities, cooling the rolled wire rod from the temperature range of 1100°–755° C. to the temperature range of 350°–500° C. at a cooling rate of 60°–300° C./sec, and holding it in this temperature range for not less than a period of Y sec determined by the following equation (3), $$Y = \exp(19.83 - 0.0329 \times T) \quad (3)$$

where

T: holding temperature (°C.).

(5) A method of producing bainite wire rod for drawing according to paragraph 4 above wherein the starting steel slab further contains Cr: 0.10–0.50% as an alloying component.

(6) A method of producing bainite wire for drawing characterized by heating to the temperature range of 1100°–755° C. wire of a composition which contains, in weight percent,

C: 0.70–1.20%,

Mn: 0.30–0.90% and

Si: 0.15–1.00%, further contains as alloying components one or both of

Al: 0.006–0.100% and

Ti: 0.01–0.35%, is limited to

P: not more than 0.02% and

S: not more than 0.01%, the remainder being Fe and unavoidable impurities, cooling the heated wire to the temperature range of 350°–500° C. at a cooling rate of 60°–300° C./sec, and holding it in this temperature range for not less than a period of Y sec determined by the following equation (3), $$Y=\exp(19.83-0.0329\times T) \quad (3)$$

where

T: holding temperature (°C.).

(7) A method of producing bainite wire for drawing according to paragraph 6 above wherein the starting wire further contains Cr: 0.10–0.50% as an alloying component.

BEST MODE FOR CARRYING OUT THE INVENTION

Figure 1:
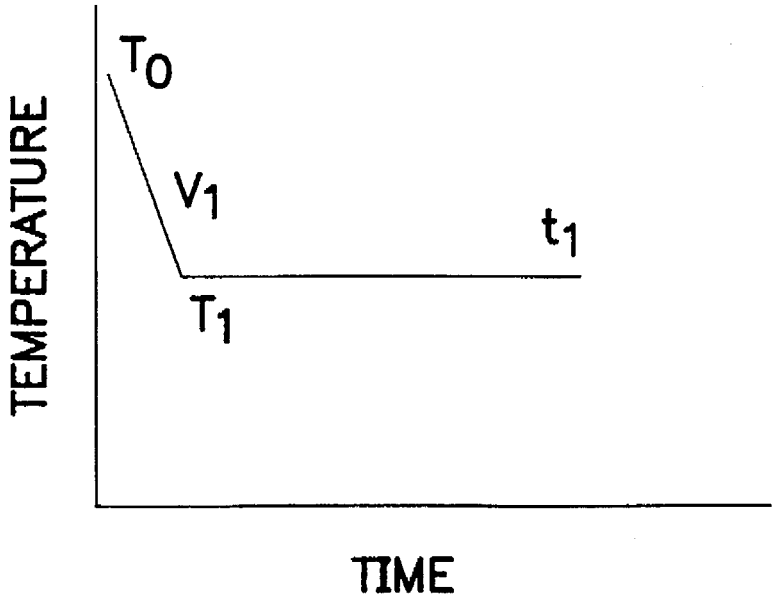
FIG. 1 is a diagram showing a heat treatment pattern of the present invention.

The reasons for the restrictions on the constituent elements of the invention will now be discussed.

The reasons for the restrictions on the chemical compositions of the starting steel slab and wire will be described in the following.

C is a fundamental element governing strength and ductility, strength increasing with higher carbon content. The lower limit of C content is set at 0.70 wt % for ensuring hardenability and strength and the upper limit is set at 1.20 wt % for preventing formation of pro-eutectoid cementite.

Si is added at not less than 0.15 wt % as a deoxidizing agent. Si is also an element which solid-solution hardens the steel and is further capable of reducing wire relaxation. However, since Si reduces the amount of scale formation, degrading mechanical scaling property, and also lowers the lubricity somewhat, the upper limit of Si content is therefore set at 1.00 wt %.

Mn is added at not less than 0.30 wt % as a deoxidizing agent. Although Mn is an element which strengthens the steel by its presence in solid solution, increasing the amount added increases the likelihood of segregation at the center portion of the wire rod. Since the hardenability of the segregated portion increases, shifting the finishing time of transformation toward the long period side, the untransformed portion becomes martensite, leading to wire breakage during drawing. The upper limit of Mn content is therefore set at 0.90 wt %.

Although Al acts as a deoxidizer and is also the most economical element for obtaining fine-grained austenite by fixing N in the steel, Al is not a required element when the N content is low. The upper limit of N content is set at 0.100 wt % in consideration of increase in nonmetallic inclusions and the lower limit is set at 0.006 wt %, where the effect of Al appears.

Ti is already currently used in Ti-deoxidized steels, mainly for adjusting the austenite crystal grains of ordinary carbon steel. The upper limit of Ti content is set at 0.35 wt % for suppressing increase of Ti inclusions and suppressing formation of solid solution carbo-nitrides in the steel. The lower limit is set at 0.01 wt %, where these actions appear to an effective degree.

The wire rod and the wire of this invention contain one or more of the two elements A1 and Ti.

Since P and S precipitate at the grain boundaries and degrade the steel properties, it is necessary to hold their contents as low as possible. The upper limit of P content is set at 0.02 wt % and the upper limit of S content is set at 0.01 wt %.

Cr, an element which increases steel strength, is added as occasion demands. While increasing the amount of Cr increases strength, it also increases hardenability and moves the transformation finishing time line toward the long period side. Since this prolongs the time required for heat treatment, the upper limit of Cr content is set at 0.50 wt %, while the lower limit thereof is set at 0.10 wt % for increasing strength.

The rolling conditions and heat treatment conditions for obtaining the bainite wire rod and wire of this invention will now be discussed.

The reason for defining the temperature from which cooling is started following wire rod rolling and the wire heating temperature as 755°–1100° C. is that 755° C. is the lower limit temperature of austenitic transformation while abnormal austenite grain growth occurs when the temperature exceeds 1100° C.

The reason for defining the cooling rate from the start of wire rod or wire cooling to the isothermal holding temperature range of 350°–500° C. as 60°–300° C./sec is that 60° C./sec is the lower limit of the critical cooling rate for formation of the upper bainite texture while 300 ° C./sec is the upper limit of the industrially feasible cooling rate.

The reason for setting the isothermal holding temperature following cooling as 350°–500° C. is that 350° C. is the lower limit temperature for upper bainite texture formation while 500° C. is the upper limit temperature for upper bainite texture formation.

The required isothermal holding time in the temperature range between 350°–500° C. is calculated from the transformation finishing time line in the TTT diagram. If the immersion time in the cooling tank is insufficient, however, martensite forms and becomes a cause for wire breakage during drawing. Since holding for not less than the finishing time of transformation is therefore required, the holding time in the temperature range of 350°–500° C. is defined as the time Y sec determined by the following equation (3).

$$Y=\exp(19.83-0.0329\times T) \quad (3)$$

where T: heat treatment temperature (°C.).

The reasons for the limitations on the characteristics of the wire rod and wire which are products of the invention will now be discussed.

Since tensile strength is strongly dependent on C content, it is given in terms of its relationship with C content in the manner of equation (1). In wire rod or wire having bainite texture, the cementite precipitation is coarser than it is in prior art wire rod and wire having pearlite texture and, therefore, the tensile strength is lower for the same composition. In wire-drawing, lowering the initial tensile strength improves the drawability and enables drawing to a high reduction of area. The tensile strength is therefore limited in the manner of equation (1) as the limit up to which the drawability is not degraded. When the upper limit is exceeded, the drawability is degraded, causing the occurrence of breakage or delamination in the course drawing.

The reduction of area is an important factor indicative of ease of processing during drawing. Even at the same tensile strength, raising the reduction of area lowers the work hardening rate and enables drawing to a high reduction of area. In wire rod having bainite texture, the cementite precipitation is coarser than it is in prior art wire rod having pearlite texture and, therefore, the reduction of area is higher for the same tensile strength. The reduction of area is therefore limited in the manner of equation (2) as the limit up to which the drawing limit is not degraded. When the lower limit is not reached, the drawability is degraded, causing the occurrence of breakage or delamination in the course drawing.

In addition to having the tensile strength and reduction of area prescribed in the foregoing, the invention wire rod or wire having bainite texture further has a microstructure of not less than 80% upper bainite texture in terms of area ratio and an Hv of not more than 450. As a result, its drawability is even further enhanced.

EXAMPLES

Example 1

Table 1 shows the chemical compositions of tested steel specimens.

A–D in Table 1 are invention steels and E and F are comparison steels.

Steel E has a C content exceeding the upper limit and steel F has a Mn content exceeding the upper limit.

The specimens were produced by casting 300×500 mm slabs with a continuous casting machine and then bloom pressing them into 122–mm square slabs.

After these slabs had been rolled into billets, they were rolled into wire rods of the diameters shown in Table 2 and subjected to DLP (Direct Lead Parenting) cooling.

The wire rods were drawn to 1.00 mmϕ at an average reduction of area of 17% and subjected to tensile test and twist test.

The tensile test was conducted using the No. 2 test piece of JISZ2201 and the method described in JISZ2241.

In the twist test, the specimen was cut to a test piece length of $100d+100$ and rotated at a rotational speed of 10 rpm between chucks spaced at $100d$. d represents the wire diameter.

The characteristic values obtained in this manner are also shown in Table 2.

No. 5–No. 10 are comparative steels.

In No. 5, pearlite which formed because the cooling rate was too slow reduced the drawability, leading to breakage during drawing.

In No. 6, pearlite which formed because the isothermal transformation temperature was too high reduced the drawability, leading to breakage during drawing.

In No. 7, martensite which formed because the isothermal transformation treatment time was short reduced the drawability, leading to breakage during drawing.

In No. 8, bainite texture did not form because the temperature from which cooling was started was too low, reducing the drawability and leading to breakage during drawing.

In No. 9, pearlite which formed because the C content was too high reduced the drawability.

In No. 10, micromartensite which formed in conjunction with central segregation caused by an excessively high Mn content reduced the drawability.

TABLE 1

Chemical Compositions of Tested Steel Specimens

| | Chemical Compositions (wt %) | | | | | | | | | | |
|---|---|---|---|---|---|---|---|---|---|---|---|
| Symbol | C | Si | Mn | P | S | Cr | Al | Ti | N | O | Remark |
| A | 0.960 | 0.18 | 0.40 | 0.012 | 0.009 | 0.25 | — | 0.30 | 0.0054 | 0.0029 | Invention |
| B | 0.930 | 0.15 | 0.30 | 0.010 | 0.008 | 0.28 | 0.080 | 0.01 | 0.0031 | 0.0030 | Invention |
| C | 1.120 | 0.16 | 0.39 | 0.013 | 0.007 | 0.35 | 0.070 | — | 0.0034 | 0.0025 | Invention |
| D | 0.900 | 0.20 | 0.35 | 0.015 | 0.008 | — | — | 0.02 | 0.0055 | 0.0036 | Invention |
| E | 1.290 | 0.11 | 0.40 | 0.018 | 0.008 | 0.20 | 0.010 | 0.01 | 0.0034 | 0.0037 | Comparison |
| F | 0.980 | 0.30 | 1.80 | 0.016 | 0.009 | 0.22 | 0.010 | 0.01 | 0.0037 | 0.0029 | Comparison |

TABLE 2

Wire Rod Rolling Conditions and Characteristic Values of Tested Steel Specimens

| | | | | | Cooling tank | | Rolled wire rod | | | | After drawing (diameter: 1.00 mm) | | | | |
|---|---|---|---|---|---|---|---|---|---|---|---|---|---|---|---|
| No. | Symbol | Diameter mm ϕ | $T_0$ °C. | $V_1$ °C./s | $T_1$ °C. | $t_1$ s | TS kgf/mm² | Reduction % | Bainite texture ratio % | Hv | TS kgf/mm² | Reduction % | Twist value (times) | Delamination | Remark |
| 1 | A | 4.0 | 950 | 120 | 450 | 160 | 140 | 50 | 95 | 430 | 260 | 40 | 25 | No | Invention |
| 2 | B | 4.5 | 1000 | 150 | 470 | 100 | 130 | 53 | 90 | 420 | 275 | 42 | 30 | No | Invention |
| 3 | C | 5.0 | 1050 | 200 | 480 | 70 | 140 | 58 | 90 | 420 | 280 | 43 | 28 | No | Invention |
| 4 | D | 5.5 | 800 | 160 | 490 | 50 | 120 | 55 | 85 | 450 | 268 | 41 | 26 | No | Invention |
| 5 | A | 5.0 | 1000 | 50 | 450 | 160 | 150 | 25 | 30 | 550 | | Broke at 1.3 mm ϕ | | | Comparison |
| 6 | B | 5.0 | 1050 | 130 | 550 | 80 | 150 | 25 | 30 | 550 | | Broke at 1.2 mm ϕ | | | Comparison |
| 7 | C | 5.5 | 1100 | 120 | 490 | 20 | 170 | 15 | 60 | 550 | | Broke at 1.4 mm ϕ | | | Comparison |
| 8 | D | 5.5 | 740 | 120 | 480 | 60 | 140 | 45 | 0 | 460 | | Broke at 1.3 mm ϕ | | | Comparison |
| 9 | E | 5.5 | 1050 | 130 | 480 | 80 | 160 | 35 | 70 | 550 | 290 | 20 | 13 | Yes | Comparison |
| 10 | F | 5.5 | 1050 | 120 | 470 | 50 | 170 | 13 | 60 | 600 | 270 | 35 | 19 | Yes | Comparison |

$T_0$: Cooling start temperature
$V_1$: Cooling rate
$T_1$: Cooling temperature
$t_1$: Cooling time Example 2

Table 3 shows the chemical compositions of tested steel specimens.

A–D in Table 3 are invention steels and E and F are comparison steels.

Steel E has a C content exceeding the upper limit and steel F has a Mn content exceeding the upper limit.

The wires were transformed to austenitic texture under the conditions shown in Table 4. After heat treatment they were drawn to 1.00 mmϕ at an average reduction of area of 17% and subjected to tensile test and twist test.

The tensile test was conducted using the No. 2 test piece of JISZ2201 and the method described in JISZ2241.

In the twist test, the specimen was cut to a test piece length of 100*d* +100 and rotated at a rotational speed of 10 rpm between chucks spaced at 100*d*. d represents the wire diameter.

In No. 6, pearlite which formed because the isothermal transformation temperature was too high reduced the drawability, leading to breakage during drawing.

In No. 7, martensite which formed because the isothermal transformation treatment time was short reduced the drawability, leading to breakage during drawing.

In No. 8, the bainite texture ratio was zero because the heating temperature was too low, reducing the drawability and leading to breakage during drawing.

In No. 9, pearlite which formed because the C content was too high reduced the drawability.

In No. 10, pearlite formed and the reduction of area was low because the Mn content was too high, reducing the drawability.

TABLE 3

Chemical Compositions of Tested Steel Specimens

| | Chemical Compositions (wt %) | | | | | | | | | | |
|---|---|---|---|---|---|---|---|---|---|---|---|
| Symbol | C | Si | Mn | P | S | Cr | Al | Ti | N | O | Remark |
| A | 0.960 | 0.18 | 0.40 | 0.012 | 0.009 | 0.25 | — | 0.30 | 0.0054 | 0.0029 | Invention |
| B | 0.930 | 0.15 | 0.30 | 0.010 | 0.008 | 0.28 | 0.080 | 0.01 | 0.0031 | 0.0030 | Invention |
| C | 1.120 | 0.16 | 0.39 | 0.013 | 0.007 | 0.35 | 0.070 | — | 0.0034 | 0.0025 | Invention |
| D | 0.900 | 0.20 | 0.35 | 0.015 | 0.008 | — | — | 0.02 | 0.0055 | 0.0036 | Invention |
| E | 1.290 | 0.11 | 0.40 | 0.018 | 0.008 | 0.20 | 0.010 | 0.01 | 0.0034 | 0.0037 | Comparison |
| F | 0.980 | 0.30 | 1.80 | 0.016 | 0.009 | 0.22 | 0.010 | 0.01 | 0.0037 | 0.0029 | Comparison |

The characteristic values obtained in this manner are also shown in Table 4.

No. 1–No. 4 are invention steels. Since they satisfy all heat treatment conditions of the invention, they can be drawn into wire that does not exhibit delamination even at 1.00 mm ϕ following drawing.

No. 5–No. 10 are comparative steels.

In No. 5, pearlite which formed because the cooling rate was too slow reduced the drawability, leading to breakage during drawing.

TABLE 4

Wire Heat Treatment Conditions and Characteristic Values of Tested Steel Specimens

| No. | Symbol | Diameter mm ϕ | $T_0$ °C. | $V_1$ °C./s | Cooling tank $T_1$ °C. | Cooling tank $t_1$ s | After heat treatment, before drawing TS kgf/mm² | After heat treatment, before drawing Reduction % | After heat treatment, before drawing Bainite texture ratio % | After heat treatment, before drawing Hv | After drawing (diameter: 1.00 mm) TS kgf/mm² | After drawing (diameter: 1.00 mm) Reduction % | After drawing (diameter: 1.00 mm) Twist value (times) | After drawing (diameter: 1.00 mm) Delamination | Remark |
|---|---|---|---|---|---|---|---|---|---|---|---|---|---|---|---|
| 1 | A | 3.0 | 950 | 120 | 450 | 160 | 140 | 50 | 95 | 430 | 260 | 40 | 25 | No | Invention |
| 2 | B | 4.0 | 1000 | 150 | 470 | 100 | 130 | 53 | 90 | 420 | 275 | 42 | 30 | No | Invention |
| 3 | C | 4.5 | 1050 | 200 | 480 | 70 | 140 | 58 | 90 | 420 | 280 | 43 | 28 | No | Invention |
| 4 | D | 5.5 | 800 | 160 | 490 | 50 | 120 | 55 | 85 | 450 | 268 | 41 | 26 | No | Invention |
| 5 | A | 5.0 | 1000 | 50 | 450 | 160 | 150 | 25 | 30 | 550 | | Broke at 1.3 mm ϕ | | | Comparison |
| 6 | B | 5.0 | 1050 | 130 | 550 | 80 | 145 | 46 | 50 | 480 | | Broke at 1.2 mm ϕ | | | Comparison |
| 7 | C | 4.8 | 1100 | 120 | 490 | 20 | 170 | 15 | 60 | 550 | | Broke at 1.4 mm ϕ | | | Comparison |
| 8 | D | 5.0 | 740 | 120 | 480 | 60 | 140 | 45 | 0 | 460 | | Broke at 1.3 mm ϕ | | | Comparison |
| 9 | E | 4.0 | 1050 | 130 | 480 | 80 | 160 | 35 | 70 | 550 | 290 | 20 | 13 | Yes | Comparison |
| 10 | F | 3.5 | 1050 | 120 | 470 | 50 | 170 | 13 | 60 | 600 | 270 | 35 | 19 | Yes | Comparison |

$T_0$: Heating temperature
$V_1$: Cooling rate
$T_1$: Cooling temperature
$t_1$: Cooling time Industrial Applicability As discussed in the foregoing, since the wire rod or wire produced in accordance with this invention can be drawn to an appreciably higher reduction of area than possible by the prior art method, it has improved delamination resistance property. The invention is therefore able to provide bainite wire rod and wire that are excellent in drawability.

We claim:

1. Bainite wire rod or wire for drawing which consists essentially of, in weight percent,
   C: 0.70–1.20%,
   Mn: 0.30–0.90% and
   Si: 0.15–1.00%,
   further consisting of, as alloying components, one or both of
   Al: 0.006–0.100% and
   Ti: 0.01–0.35%,
   is limited to
   P: not more than 0.02% and
   S: not more than 0.01%,
   the remainder being Fe and unavoidable impurities, and which has a microstructure of not less than 80% upper bainite texture in terms of area ratio and an Hv of not more than 450, and has tensile strength and reduction of area determined by the following equations (1) and (2), $$TS \leqq 85 \times (C) + 60 \quad (1)$$

$$RA \geqq -0.875 \times (TS) + 158 \quad (2)$$

where
   C: carbon content (wt %),
   TS: tensile strength (kgf/mm²), and
   RA: reduction of area (%).

2. Bainite wire rod or wire for drawing according to claim 1 which has tensile strength not exceeding 140 kgf/mm².

3. Bainite wire rod or wire for drawing according to claim 1 which further consists essentially of Cr: 0.10–0.50% as an alloying component.

4. A method of producing bainite wire rod for drawing which comprises
   rolling into wire rod a steel slab of a composition which contains, in weight percent,
   C: 0.70–1.20%,
   Mn: 0.30–0.90% and
   Si: 0.15–1.00%,
   further contains as alloying components one or both of
   Al: 0.006–0.100% and
   Ti: 0.01–0.35%,
   is limited to
   P: not more than 0.02% and
   S: not more than 0.01%,
   the remainder being Fe and unavoidable impurities,
   cooling the rolled wire rod from a temperature range of 1100°–755° C. to the temperature range of 350°–500° C. at a cooling rate of 60°–300° C./sec, and
   holding it in this temperature range for not less than a period of Y sec determined by the following equation (3), $$Y = \exp(19.83 - 0.0329 \times T) \quad (3)$$

where
   T: holding temperature (°C.).

5. A method of producing bainite wire rod for drawing according to claim 4 wherein the starting steel slab further contains Cr: 0.10–0.50% as an alloying component.

6. A method of producing bainite wire for drawing which comprises
   heating to a temperature range of 1100°–755° C. wire of a composition which
   contains, in weight percent,
   C: 0.70–1.20%,
   Mn: 0.30–0.90% and
   Si: 0.15–1.00%,
   further contains as alloying components one or both of
   Al: 0.006–0.100% and
   Ti: 0.01–0.35%,
   is limited to
   P: not more than 0.02% and
   S: not more than 0.01%,
   the remainder being Fe and unavoidable impurities,
   cooling the heated wire to a temperature range of 350°–500° C. at a cooling rate of 60°–300° C./sec, and holding it in this temperature range for not less than a period of Y sec determined by the following equation (3), $$Y=\exp(19.83-0.0329\times T) \quad (3)$$

where

T: holding temperature (°C.).

7. A method of producing bainite wire for drawing according to claim 6 wherein the starting wire further contains Cr: 0.10–0.50% as an alloying component.

* * * * *